United States Patent [19]

Piesen et al.

[11] Patent Number: 4,596,108

[45] Date of Patent: Jun. 24, 1986

[54] APPARATUS FOR CONFINING ROLLS OF CONVOLUTED PAPER OR THE LIKE

[75] Inventors: Stephan Piesen, Krefeld; Jacob Hannen, Willich, both of Fed. Rep. of Germany

[73] Assignee: Kleinewefers GmbH, Krefeld, Fed. Rep. of Germany

[21] Appl. No.: 695,735

[22] Filed: Jan. 28, 1985

Related U.S. Application Data

[63] Continuation of Ser. No. 338,908, Jan. 12, 1982, abandoned.

[30] Foreign Application Priority Data

Jan. 13, 1981 [DE] Fed. Rep. of Germany ..... 3100754

[51] Int. Cl.[4] ..... B65B 61/00

[52] U.S. Cl. ..... 53/137; 53/211; 156/570; 271/164

[58] Field of Search ..... 53/137, 211; 156/565, 156/570, 573; 271/162, 164

[56] References Cited

U.S. PATENT DOCUMENTS

| | | | |
|---|---|---|---|
| 2,110,815 | 3/1938 | Parsons | 53/137 X |
| 2,681,534 | 6/1954 | Way | 53/137 X |
| 2,803,935 | 8/1957 | Gibson | 53/137 X |
| 4,178,122 | 12/1979 | Abrahamson | 198/409 |
| 4,339,904 | 7/1982 | Koutonen | 53/211 |
| 4,375,285 | 3/1983 | Dennhardt | 271/162 |

FOREIGN PATENT DOCUMENTS

| | | | |
|---|---|---|---|
| 1275440 | 8/1968 | Fed. Rep. of Germany | 53/137 |

*Primary Examiner*—John Sipos

*Attorney, Agent, or Firm*—Peter K. Kontler

[57] ABSTRACT

Apparatus for providing rolls of convoluted paper or the like with cylindrical envelopes defines an elongated path wherein the rolls are advanced sideways first to a centering station where the end faces of successive rolls are overlapped by inner discs which are attached to the rolls by plugs extending into the end portions of central openings provided in the cores of the respective rolls. The rolls are thereupon advanced to a draping station where they are set in rotary motion and provided with blanks of wrapping paper whose marginal portions are folded over the outer sides of the inner discs before the rolls advance to a pressing station where the folded-over marginal portions of the blanks are compressed against the outer sides of the inner discs and, at the same time, the pressing plates of the pressing device apply outer discs to the folded-over marginal portions to thus complete the making of cylindrical envelopes for the respective rolls. The inner and outer discs are stored in pairs of magazines having batteries of superimposed drawers which are movable between horizontal and vertical positions and from which the outermost or uppermost discs are withdrawable by suction heads for application against the end faces of the rolls or against the folded-over marginal portions of the blanks.

23 Claims, 9 Drawing Figures

APPARATUS FOR CONFINING ROLLS OF CONVOLUTED PAPER OR THE LIKE

CROSS-REFERENCE TO RELATED APPARATUS

This application is a continuation of application Ser. No. 338,908, filed Jan. 12, 1982 now abandoned.

An apparatus certain details of which are similar to portions of the apparatus of the present invention is manufactured by the assignee of the present application under the designation "Kleinewefers Rollenpackmaschine Typ 6.6". A modified apparatus is disclosed in commonly owned copending application Ser. No. 335,560 filed Dec. 22, 1981 by Stephan PIESEN and Joze ZAJEC for "Apparatus for manipulating rolls of convoluted paper or the like" now U.S. Pat. No. 4,485,612.

BACKGROUND OF THE INVENTION

The present invention relates to apparatus for manipulating substantially cylindrical rolls which consist of convoluted paper, metallic foil, plastic foil, cardboard or the like, and more particularly to improvements in apparatus for confining such rolls in hollow cylindrical envelopes of the type having inner disc-shaped end walls (hereinafter called inner discs) adjacent to the end faces of a roll, a blank of wrapping material which surrounds the periphery of the roll and whose marginal portions are folded over the inner discs, and outer disc-shaped end walls (hereinafter called outer discs) which are adhesively secured to the folded-over marginal portions of the blank. Still more particularly, the invention relates to improvements in devices for supplying inner and/or outer discs to the disc-applying components of such apparatus so as to ensure predictable, rapid and inexpensive application of inner and/or outer discs.

It is already known to store differently dimensioned discs in a magazine and to operate the magazine in such a way that discs of selected diameter can be withdrawn therefrom by suction prior to delivery of removed discs into the range of devices which apply removed discs to the end faces of a roll or to folded-over marginal portions of a blank surrounding the roll and confining the inner discs. Reference may be had to U.S. Pat. No. 4,339,904 which discloses an apparatus whose magazine comprises a series of superimposed plates pivotable about a common vertical axis which is remote from the plates. The transfer mechanism for discs employs a horizontally extending suction-operated holding element which is designed to engage the topmost inner disc of a stack of discs on a plate which has been pivoted out of the magazine. The holding element transports the withdrawn inner disc to a position substantially at a level above a pressure-applying plate which constitutes the clamping head, and the inner disc is then pivoted into a vertical plane prior to being lowered into the range of the clamping head which attracts the lowered disc and applies it to the repective end face of a roll.

The just discussed prior apparatus exhibits a number of drawbacks. Thus, problems are likely to arise during removal of the uppermost disc of a stack of such discs on a selected plate of the magazine. Suction must be uniform over the entire area of a disc, not only as regards the distribution of suction ports but also as concerns the intensity of suction. As a rule, the intensity of suction must be quite pronounced which presents problems when the dimensions of the inner discs are relatively small so that numerous suction ports of the holding element remain exposed and thus affect the intensity of suction acting on a small-diameter disc. Moreover, the space requirements of the aforediscussed apparatus are considerable; thus, the apparatus must afford space whose length corresponds to twice the diameter of the largest disc, as considered in the direction of travel of rolls.

OBJECTS AND SUMMARY OF THE INVENTION

An object of the invention is to provide an apparatus which can remove discs from their magazines in a novel and improved way, which is compact and simple, which can be installed in existing production lines for the making and processing of rolls consisting of convoluted textile material, paper or the like, and whose operation can be automated to any desired extent.

Another object of the invention is to provide an apparatus wherein discrete discs can be removed from their magazines with a high degree of reliability and without the exertion of substantial forces.

A further object of the invention is to provide novel and improved mechanisms for transferring inner and outer discs from their magazines to optimum positions for application to the end faces of rolls and to the folded-over marginal portions of draped blanks.

An additional object of the invention is to provide the just mentioned mechanisms with novel and improved means for changing the orientation of inner and outer discs during transfer from their magazines to optimum position for application to the end faces of rolls and to the blanks surrounding such rolls.

Still another object of the invention is to provide novel and improved means for securing inner discs to the end faces of successive rolls.

A further object of the invention is to provide relatively simple and compact magazines for storage of sets of inner and outer discs in an apparatus of the above outlined character.

An additional object of the invention is to provide the apparatus with novel and improved means for withdrawing discrete inner and outer discs from their respective magazines.

An ancillary object of the invention is to provide an apparatus wherein appropriate inner and outer discs for the application to rolls having given diameters can be selected automatically as a result of monitoring the dimensions of successive rolls.

The invention is embodied in an apparatus for moving discs against or close to the end faces of substantially horizontal rolls consisting of convoluted paper or the like. The apparatus comprises a magazine including a plurality of substantially horizontal superimposed receptacles (preferably in the form of drawers installed in discrete compartments of the magazine) for stacks of discs therein, a transporting device including conveyor means for moving a selected receptacle from and back into the magazine in a substantially horizontal plane and means for pivoting a withdrawn receptacle from the horizontal plane into a substantially vertical plane and back into the horizontal plane, and means for applying to the roll a disc removed from a receptacle which is held in the vertical plane. Each of the receptacles is preferably arranged to store a supply of discs having a given diameter which deviates from the diameters of discs in each other receptacle. This enables the apparatus to apply discs to larger-diameter or smaller-diameter rolls.

The aforementioned compartments of the magazine are preferably horizontal, and each receptacle or drawer is reciprocable in the horizontal plane between positions within and outside of the respective compartment.

Each applying means can comprise a suction head. The rolls are preferably arranged to advance along an elongated path which is preferably horizontal and wherein the rolls advance by moving sideways (i.e., at right angles to their respective axes), and the magazine is disposed at one side of such path. The apparatus preferably further comprises a second magazine which is located at the other side of the path of movement of rolls, and the transporting device then comprises second conveyor means for moving a selected receptacle from and into the second magazine by moving the receptacle in the horizontal plane and means for pivoting a receptacle (which is withdrawn from the second magazine) from the horizontal plane into a second vertical plane and back into the horizontal plane. The apparatus then also comprises a second suction head or other suitable means for applying to the roll a disc removed from the receptacle which is held in the second vertical plane. The apparatus can also comprise lifting means for moving the receptacles of both magazines up and down so as to place a selected receptacle into the horizontal plane at each side of the aforementioned path for the rolls.

The transporting device preferably comprises horizontal guide means for the receptacle or receptacles which are located in the horizontal plane, and the conveyor means are arranged to move such receptacle or receptacles along the guide means, i.e., into and from the respective magazine.

If the applying means is spaced apart from the respective magazine, the apparatus further comprises drive means which is operable to move discs in the vertical plane and into register with the applying means. The drive means can include a longitudinal drive which is adapted to move receptacles in the vertical plane in a direction at right angles to the direction of movement of receptacles in the horizontal plane. Alternatively, the drive means can comprise a transporting device which is adapted to move discrete discs from a receptacle in the vertical plane to the applying means, e.g., to a pressing plate forming part of a device which presses folded-over marginal portions of draped blanks against the inner discs which are already connected to the roll and are overlapped by the folded-over marginal portions. The just mentioned transporting device can comprise a suction head and means (e.g., an arm which is pivotabl-e about a preferably horizontal axis) for moving the suction head back and forth along a predetermined path between a receptacle in the vertical plane and the applying means (such as a pressing plate).

The apparatus can further comprise means for retaining discs on the end faces of rolls and means for securing such retaining means to the respective rolls. The rolls are preferably of the type having a centrally located opening with end portions in the end faces of the roll (the opening may constitute the axial bore or hole of a cylindrical core around which the supply of paper or the like is convoluted to form a roll). The apparatus then further comprises a source of retaining means, e.g., a magazine for a supply of plugs each having a shank and a larger-diameter flange at one axial end of the shank. The securing means can include a plunger or a like device for removing retaining means from the source and for moving the removed retaining means against a disc which is held by the applying means and thereupon with the disc against an end face of a roll. The aforementioned shank of each plug is receivable in the respective end portion of the opening in the roll. The disc can be provided with centrally located apertures for the shanks of the plugs and the applying means can have a passage through which the plugs are advanced from the source whereby the flanges of the plugs strip the discs off the applying means and cause the thus stripped discs to advance with the plugs toward and against the end face of an adjacent roll. The applying means can constitute a component part of means for centering each of a series of rolls in a predetermined position in which the roll is held during application of one of two discs thereto.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
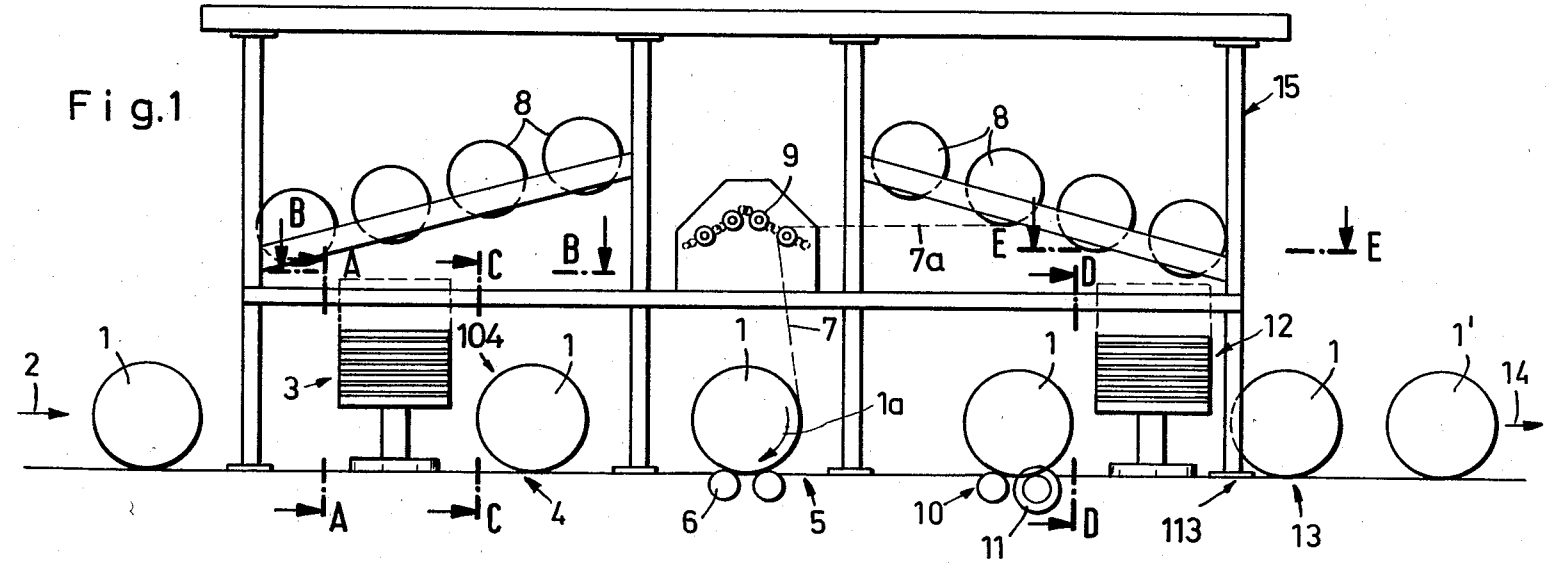
FIG. 1 is a schematic side elevational view of an apparatus which embodies the invention.

The packing or confining apparatus of FIG. 1 comprises a system which conveys a series of successive rolls 1 (each such roll consists of convoluted paper, metallic foil, plastic foil, cardboard or a like sheet- or web-shaped material) along a substantially horizontal path in the direction indicated by arrow 2. The rolls 1 are advanced in such a way that they move sideways, namely, at right angles to the axes of their respective cores. The axis of each of the rolls 1 shown in FIG. 1 extends at right angles to the plane of the drawing.

The apparatus comprises two magazines 3 each of which constitutes a source of supply of inner discs 22 (see particularly FIG. 2) which are to be applied to the end faces 1*e* of successive rolls reaching a centering device or applicator 4. The centering device 4 includes means for applying pairs of inner discs 22 to each roll 1 which arrives at the centering station 104. The applicator 4 at the centering station 104 comprises means for centering each oncoming roll 1 in an optimum position for the application of two coaxial inner discs 22 thereto.

Each centered roll 1 is caused to advance to a draping station 5 where the roll (which already carries two inner discs 22, each applied to one of the two end faces 1*e* of the roll) is set in rotary motion (in the direction indicated by arrow 1*a*) by two horizontal driven rollers 6 shown in the lower central portion of FIG. 1. During rotation at the draping station 5, the roll 1 which is driven by the rollers 6 is provided with a wrapper consisting of a blank 7 which is severed from a web 7*a* of coherent blanks. Such web is delivered by a set of advancing rollers 9 which are installed at a level above the draping station 5 and can draw the web 7*a* from a selected one of a series of reels or bobbins 8 mounted in a stationary housing or frame 15 of the apparatus. The axial lengths of the reels 8 deviate from each other so that the attendants or an automatic system can select that reel which contains a web 7*a* having a width exceeding the axial length of the roll 1 at the draping station 5 by a predetermined extent. This is necessary and desirable because the marginal portions of each blank 7 should extend beyond the inner discs 22 at the end faces 1*e* of the roll 1 which is located at the draping station 5 so that the marginal portions can be folded over the respective inner discs 22 at a folding station 10 which follows the draping station 5 (as considered in the direction of arrow 2) and accommodates two folding wheels 11 each adjacent to a different axial end of the roll 1 at the station 10.

The folding station 10 is followed by a station accomodating two additional magazines 12 which contain supplies of outer discs 52. Such discs are applied against the exposed sides of the folded-over marginal portions of blanks 7 which surround the peripheral surfaces of the respective rolls 1 at a pressing station 113 accommodating a pressing device 13 serving to press the folded-over marginal portions of the blanks 7 against the outer sides of the respective inner discs 22. The folded-over marginal portions of the blanks 7 and/or the inner sides of the outer discs 52 are coated with adhesive so that the outer discs adhere to the respective folded-over marginal portions when the respective rolls 1 leave the pressing station 113. A finished roll 1', shown in the right-hand portion of FIG. 1, is thereupon transported in the direction indicated by an arrow 14 so as to advance to the next procession station or to another destination, such as into storage or onto a vehicle which transports rolls to a purchaser or consumer. At least some component parts of the units and/or devices at various processing stations shown in FIG. 1 are mounted in, adjacent to, or within the confines of the housing 15.

Figure 4:
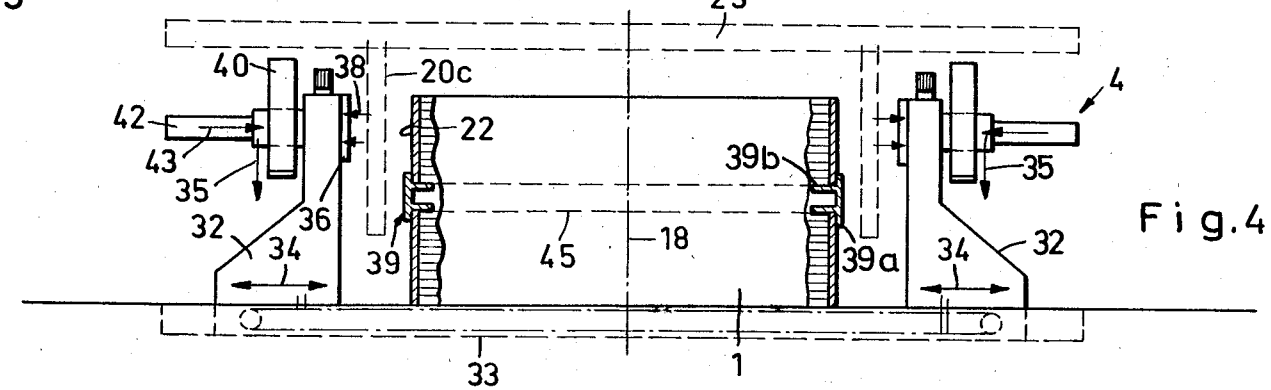
FIG. 4 is an enlarged rear elevational view of the centering station substantially as seen in the direction of arrows from the line C—C of FIG. 1.
Figure 2:
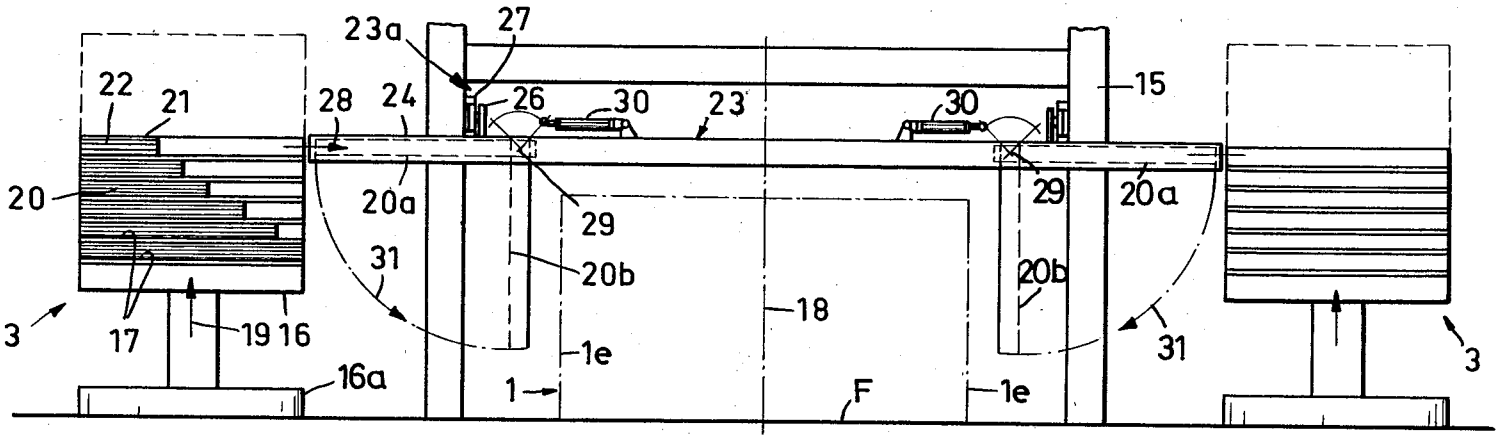
FIG. 2 is an enlarged view as seen in the direction of arrows from the line A—A of FIG. 1 and shows the rear sides of the magazines for inner discs as well as certain parts of the mechanism which transfers inner discs from such magazines to the respective disc-applying devices.
Figure 3:
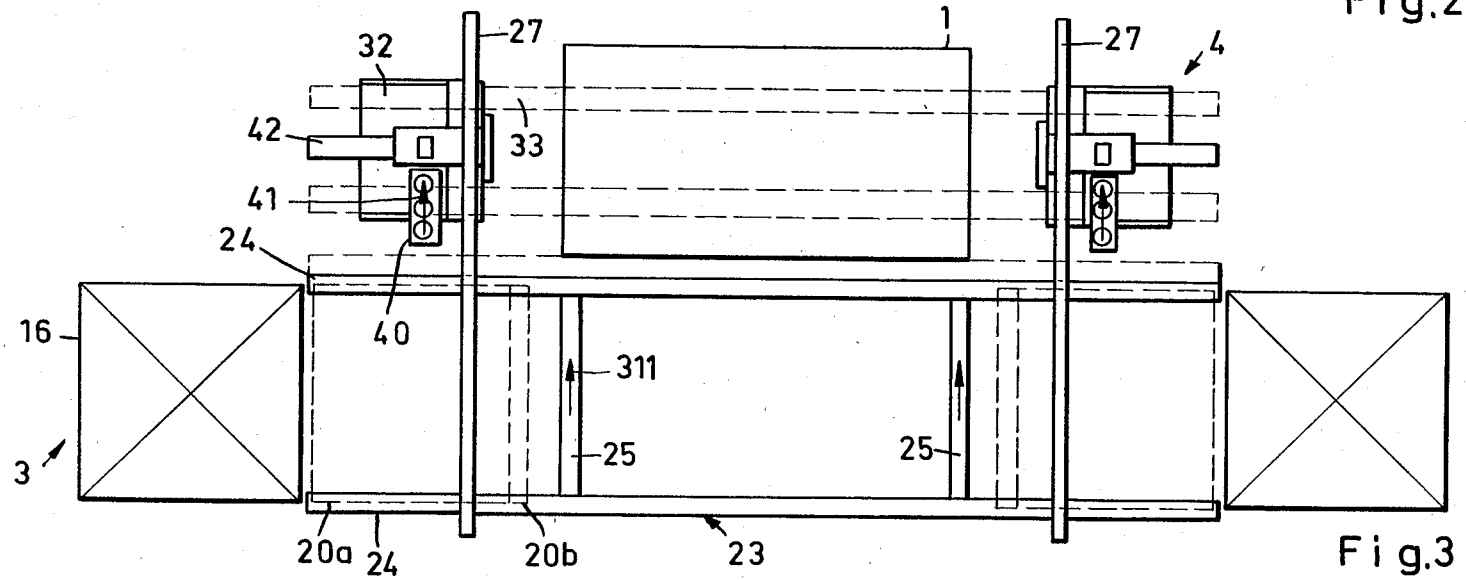
FIG. 3 is an enlarged plan view substantially as seen in the direction of arrows from the line B—B of FIG. 1, and shows the magazines and the mechanism of FIG. 2 as well as the centering station for successive rolls which are about to be provided with inner discs.

FIGS. 2, 3 and 4 illustrate the mechanism which applies inner discs 22 to the end faces 1*e* of rolls 1 at the centering station 104. Each of the aforementioned magazines 3 constitutes or comprises a rack or cabinet 16 defining a plurality of superimposed horizontal compartments 17 for discrete drawers or receptacles 20 each containing a stack 21 of overlapping inner discs 22. The inner sides of the racks 16, namely those sides which face a central vertical symmetry plane 18 halving a properly centered roll 1 at the station 104, are open so as to permit withdrawal of drawers 20. Each rack 16.is movable up and down by a discrete lifting device 19 which is indicated schematically by a vertical arrow (see FIG. 2). The lifting devices 19 can comprise or constitute double-acting hydraulic or pneumatic cylinder and piston units, rack and pinion drives, endless chains driven by electric motors or other suitable means which can lift or lower the racks 16 between several levels so as to place any one of the several compartments 17 to a position at a predetermined distance above the floor F of the plant in which the improved apparatus is put to use. One position of each rack 16 shown in FIG. 2 is indicated by solid lines, and a different position of each such rack with reference to its base 16*a* is indicated in FIG. 2 by broken lines. The diameters of inner discs 22 in the uppermost drawers 20 of the racks 16 are smaller than the diameters of discs 22 in the drawers 20 therebelow, and so forth. In other words, the lowermost drawers 20 of the two racks 16 accommodate inner discs 22 of maximum diameter.

The mechanism which is shown in FIGS. 2 to 4 further comprises a transporting device 23 which can move drawers 20 from the respective magazines 3 toward the central symmetry plane 18 and back, and comprises a frame including transverse guide elements 24 connected to each other by longitudinally extending rods, bars, strips or analogous connectors 25. The frame of the transporting device 23 constitutes or includes a longitudinal conveyor 23*a*, and its upper side is provided with rollers 26 extending into longitudinally extending tracks or ways 27. The tracks for the rollers 26 extend all the way to the centering station 104.

The transporting device 23 further comprises a transverse drive or conveyor which is indicated by an arrow 28 and which can simultaneously move two drawers 20 in a horizontal plane in directions toward or away from the symmetry plane 18, preferably through increments of identical length. The conveyor 28 can comprise an endless chain having horizontal upper and lower reaches. The upper reach is coupled to a left-hand drawer 20 at the level of the transverse guide elements 24, and the lower reach of such chain is coupled to a drawer 20 of the right-hand magazine 3 shown in FIG. 2. This ensures that, when the chain is driven by a reversible motor or the like, the two drawers 20 at the level of the transverse guide elements 24 invariably advance toward or away from each other (depending on the direction of rotation of the motor for the chain) through increments of identical length. The drawers 20 which are withdrawn from the respective magazines 3 and are still located at the level of the transverse guide elements 24 assume the positions 20*a* shown in FIG. 2. Such drawers are thereupon pivoted (see the arrows 31) about horizontal pivot axes 29 by two tilting devices 30 of the transporting device 23 so that the respective drawers are moved into vertical or nearly vertical planes and assume the positions 20*b* shown in FIG. 2 before being pivoted back to the positons 20*a*. These drawers are then adjacent to the end faces 1*e* of a roll 1 approaching the centering station 104 of FIG. 1. In such positions of the drawers 20, their open sides face away from each other, namely, away from the adjacent end faces 1*e* of a roll 1 therebetween. The drawers 20 (in the positions 20*b* shown in FIG. 2) are thereupon engaged by a longitudinal drive 311 which is indicated in FIG. 3 by arrows and which can comprise double-acting hydraulic or pneumatic cylinder and piston units of known design. The drives 311 transport the drawers 20 from the positions 20*b* to the positions 20*c* shown in FIG. 4 and back to the positions 20*b*. When they assume the positions 20*c*, the two selected drawers 20 are adjacent to the respective end faces 1*e* of a roll 1 at the centering station 104.

It will be noted that the transporting unit 23 comprises means for drawing selected drawers 20 from the respective magazines 3 toward the central symmetry plane 18 while maintaining such drawers in horizontal positions, means for thereupon pivoting or tilting the selected drawers from horizontal to vertical positions at a location ahead or upstream of the centering station 104, and means for advancing the downwardly pivoted selected drawers 20 in the direction of the arrow 2 so that such drawers can advance in vertical planes which are adjacent and parallel to the respective end faces 1*e* of the roll 1 moving toward or located at the centering station 104. A drawer 20 which has been moved to the position 20*c* is thereupon returned to the position 20*b*, from there to the position 20*a*, and from the position 20*a* back into the respective magazine 3.

The centering station 104 accommodates the aforementioned applicator or centering device 4 which includes two centering blocks 32 disposed at the opposite sides of the central symmetry plane 18 and movable by a chain drive 33 or the like in directions indicated by double-headed arrows 34 shown in FIG. 4. The extent to which the left-hand block 32 is movable toward or away from the plane 18 is the same as the extent to which the right-hand block 32 is movable toward or away from such plane. The blocks 32 support discrete clamping or disc-applying heads 36 which are movable up and down by lifting means or elevators indicated by vertical arrows 35 shown in FIG. 4. The purpose of the elevators 35 is to move the heads 36 to the level of the core 45 of the roll 1 at the centering station 104.

Figure 5:
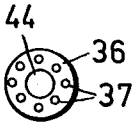
FIG. 5 is an end elevational view of one of the disc-applying devices at the centering station.

As shown in FIG. 5, the inner sides of the heads 36 are formed with one or more annuli of suction ports 37 which are connectable with a suitable suction generating device so that the head 36 can attract the outermost inner discs 22 in the respective drawers 20 while such drawers assume the positions 20*c* shown in FIG. 4 by broken lines. This results in transfer of outermost discs 22 from the drawers 20 (in the positions 20*c*) in the directions indicated by arrows 38 so that the outer side of each withdrawn disc 22 adheres to the adjacent perforated or apertured surface of the respective head 36. Once the heads 36 have withdrawn discrete discs 22 from the respective drawers 20 (in the positions 20*c*), such drawers are returned into the respective magazines 3 by reversing the sequence of the aforedescribed movements, namely, from the positons 20*c* to the positions 20*b* thereupon from the positions 20*b* to the positions 20*a* (namely, counter to the directions indicated by arcuate arrows 31 shown in FIG. 2), and thereupon from the positions 20*a* back into the respective compartments 17 of the corresponding racks 16. This provides room for the transfer of withdrawn inner discs 22 from the inner sides of the heads 36 to the respective end faces 1*e* of the roll 1 at the centering station 104.

Each centering block 32 further supports a discrete container 40 constituting a source of supply of retaining means in the form of plugs 39 (see particularly FIG. 4) which serve as a means for retaining the applied inner discs 22 in contact with the respective end faces 1*e* of the roll 1 at the centering station 104. The containers 40 are movable in and counter to the directions indicated by arrows 41 shown in FIG. 3 so as to move the foremost plugs 39 into register with the respective ends of axial bores or holes in the core 45 of the roll 1 at the station 104. The foremost plugs 39 which are in accurate register with the respective heads 36 are thereupon expelled from the respective containers 40 by reciprocable plungers 42 or analogous securing devices which cause the expelled plugs to advance in directions indicated by arrows 43 whereby the expelled plugs advance through the centrally located passages or holes 44 (see FIG. 5) of the heads 36 prior to entering the respective ends of the hole or bore in the core 45 of the roll 1 at the station 104. The flanges 39*a* of the plugs 39 thereby strip the discs 22 off the respective heads 36 and cause the discs to abut against the respective end faces 1*e* as soon as the shanks 39*b* of the plugs 39 enter the core 45. The extent of frictional engagement between the shanks 39*b* and the internal surface of the core 45 suffices to ensure that the inner discs 22 are securely maintained in contact with the respective end faces 1*e* during subsequent transfer or transport of the corresponding roll 1 from the centering station 104 to the draping station 5 of FIG. 1, during rotation of the roll 1 at the station 5 under the action of the rollers 6, as well as during folding of the overlapping marginal portions of the corresponding blanks 7 by the wheels 11 at the folding station 10 which follows the draping station 5 of FIG. 1.

Each disc 22 has a centrally located aperture for the shank 39*b* of the respective retaining plug 39. The diameters of the apertures of the discs 22 are smaller than the diameters of the flanges 39*a*. This ensures that a flange 39*a* can strip the disc 22 off the respective suction head 36 while the aligned securing means 42 moves such plug toward the respective end face 1*e* of the roll 1 at the station 104.

It will be noted that the mechanism of FIGS. 2, 3 and 4 comprises two halves which are mirror symmetrical to each other with reference to the plane 18. Therefore, the right-hand half of such mechanism is shown only schematically in FIGS. 2, 3 and 4 for the sake of simplicity.

FIGS. 2, 3 and 4 further show that the distance between each magazine 3 and the path of movement of a roll 1 toward the centering station 104 need not exceed the diameters of the largest inner discs 22 (in the lowermost drawers 20 of the respective racks 16). This contributes to compactness of the improved apparatus. The just discussed spacing is desirable and necessary because it renders it possible to pivot a selected drawer 20 at each side of the path for the rolls 1 while a roll advances between the magazines 3. In other words, the distance between the two pivot axes 29 and the inner sides of the respective magazines 3 need not exceed the diameters of the largest inner discs 22 which are stored in the magazines 3.

The mechanism which is shown in FIGS. 6, 7, 8 and 9 serves to apply outer discs 52 over the folded-over marginal portions of blanks 7 leaving the folding station 10 of FIG. 1. Such mechanism comprises the aforementioned magazines 12 which flank the path of movement of successive rolls 1 from the draping station 10 to the pressing station 113. Each of the magazines 12 comprises a rack 46 which is movable up and down by a lifting device 49 indicated by an arrow (see FIG. 6). The racks 46 have several superimposed parallel compartments 47 for discrete drawers 50 each of which contains a stack 51 of superimposed outer discs 52. The diameters of discs 52 in the uppermost drawers 50 are smaller than the diameters of discs 52 in the drawers 50 therebelow, and so forth toward the bottom parts of the respective racks 46. The lifting devices 49 serve to lift or lower selected drawers 50 into a removing plane which is the plane of a transporting device 53 serving to withdraw a drawer 50 from each of the magazines 12 and to move the withdrawn drawers through identical distances but in opposite directions toward or away from the centeral symmetry plane 18.

The transporting device 53 comprises transverse guide elements 54 and transverse conveyors which are indicated by arrows 55. Each of the transverse conveyors 55 can withdraw a drawer 50 from the respective magazine 12 and advance the withdrawn drawer to the position 50*a* shown in FIG. 6. The transporting device 53 further comprises two tilting devices 56 which can pivot the drawers 50 about fixed pivot axes 57 from the positons 50*a* in the directions indicated by arrows 58 and to the vertical positions 50*b* shown in FIG. 6. When the drawers 50 assume the vertical positions 50*b* shown in FIG. 6, their open sides face the central symmetry plane 18.

Figure 8:
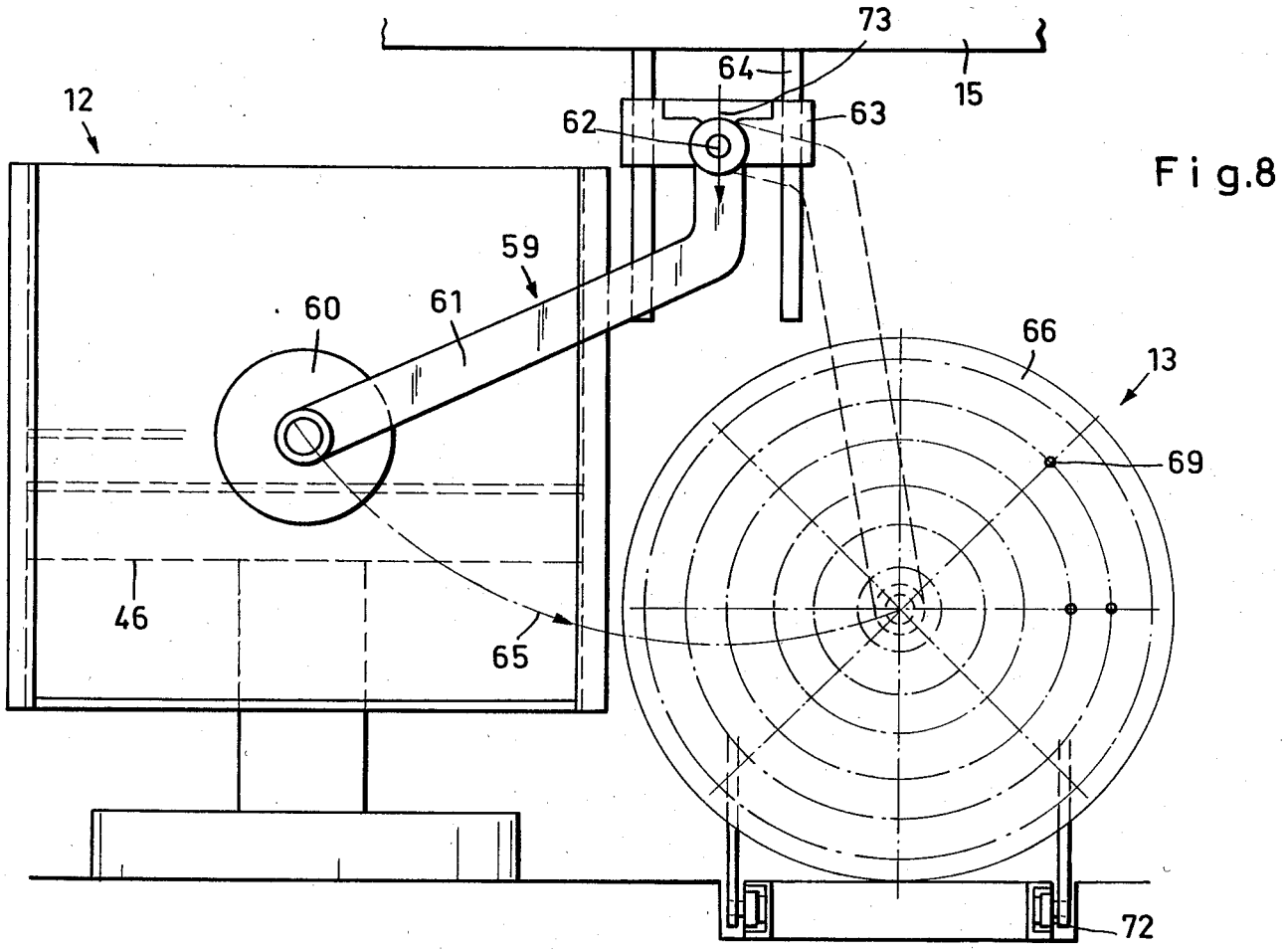
FIG. 8 is an enlarged view as seen in the direction of arrows from the line F—F of FIG. 6.
Figure 9:
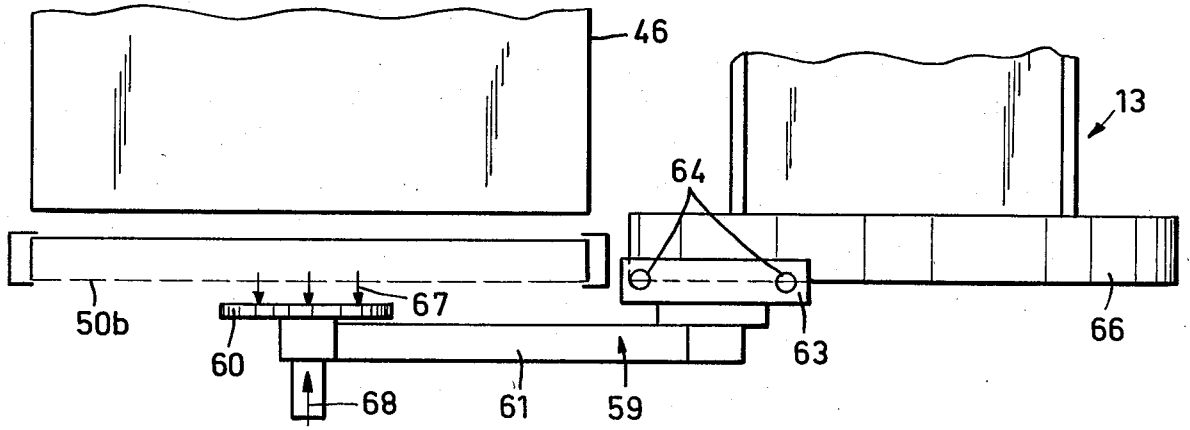
FIG. 9 is a fragmentary plan view of the structure which is shown in FIG. 8.

The transporting device 53 further comprises means 59 for transferring the innermost discs 52 from the drawers 50 (in positions 50*b*) into the range of pressing plates 66 forming part of the pressing device 13 at the station 113. The transferring means 59 comprise suction heads 60 which are analogous to the clamping heads 36 shown in FIGS. 4 and 5 and have suction ports (not specifically shown) which can attract the nearest discs 52 in the adjacent drawers 50 (in the positions 50*b* of such drawers). Each head 60 is mounted at the free end of a pivotable supporting arm 61 which is turnable about the axis of a horizontal shaft 62 installed in a holder or block 63 movable up and down (see the arrow 73 in FIG. 8) along vertical tie rods 64. The direction in which the arm 61 of FIG. 8 is pivotable to move the head 60 from the solid-line positon to a position of coaxiality with the pressing plate 66 of the pressing device 13 is indicated by the arrow 65. The arrows 67 shown in FIG. 9 indicate the directions in which the ports of the head 60 attract the innermost disc 52 from the interior of the adjacent drawer 50 (in the position 50*b* of such drawer). If desired or necessary, the arms 61 can carry drive means (one indicated in FIG. 9 by the arrow 68) for moving the respective heads 60 toward or away from the adjacent drawers (in the positons 50*b* of such drawers).

Each pressing plate 66 is a suction head having a large number of suction ports 69 (shown in FIG. 8) which can attract outer discs 52 delivered by the repective heads 60. The pressing plates 66 are mounted on blocks 70 (see FIG. 7) which are movable toward and away from each other (namely, toward and away from the symmetry plane 18) by discrete drives 71. The drives 71 can move the respective blocks 70 along tracks 72 one of which is shown in FIG. 8. The force with which the drives 71 can advance the blocks 70 and the pressing plates 66 toward each other suffices to ensure that the adhesive-coated sides of the outer discs 52 are securely attached to the folded-over marginal portions of the respective blanks 7.

Each pressing plate 66 is a functional equivalent of a suction head 36, i.e., it constitutes a means for applying outer discs 52 to the adjacent portions of draped blanks 7 on successive rolls 1.

As shown in FIG. 1 and again in FIG. 8, the magazines 12 are located relatively close to the path of movement of the rolls 1. In spite of such proximity of the magazines 12 to the just mentioned path, it is still possible to tilt pairs of drawers 50 from the positions 50*a* to the positions 50*b* of FIG. 6 because such tilting of the drawers can take place while a roll 1 approaches or has advanced beyond the space between the two aligned magazines 12. The arrangement is such that a roll 1 can pass between the magazines 12 when two selected drawers 50 assume the positions 50*a* or 50*b*. This can be readily seen in FIG. 6.

An important advantage of the improved apparatus is that its mechanisms 23 and 53 can move selected drawers 20 or 50 from substantially horizontal planes into substantially vertical planes. This simplifies the task of removing the outermost discs 22 or 52 from the respective drawers (in the positions 20*c* or 50*b*) and ensures that the removal of outermost discs can take place by exertion of relatively small forces. In other words, suction which must be applied by the heads 36 and 60 for removal of the respective discs 22 and 52 need not be very pronounced because the forces acting in directions indicated by arrows 38 and 67 need not lift the topmost discs above and away from the discs therebelow but are merely required to move discs 22 or 52, which are already located in vertical or nearly vertical planes, away from the neighboring discs 22 or 52 which are also located in vertical or nearly vertical planes. Thus, once a disc 22 or 52 is moved adjacent to the respective head 36 or 60, the head must merely effect a separation of the outermost disc 22 or 52 from the neighboring disc without being required to lift the outermost disc above and away from the neighboring disc. When a head 36 or 60 thereupon moves the freshly separated disc 22 or 52 away from the drawer which is adjacent thereto and is held in the position 20*c* or 50*b*, friction between the moving head and the disc which is attracted thereto by suction must merely suffice to counteract the weight of the disc which, at such time, is located in a vertical or at least substantially vertical plane. It has been found that the improved apparatus can utilize suction heads whose dimensions are only a small fraction of the dimensions of suction heads in certain heretofore known apparatus for the application of inner and/or outer discs. In fact, the diameter of each head 36 or 60 can be much smaller than the diameter of the smallest disc 22 or 52. This reduces losses due to escape of air when the suction ports of the heads 36 and 60 are connected with the associated suction generating devices.

Another important advantage of the improved apparatus is that the stacks of discs 22 and 52 are stored in drawers or analogous receptacles which can be readily moved in horizontal planes, tilted and moved to and/or in vertical planes without disturbing the distribution or orderly array of discs 22 or 52 therein. Moreover, and since the drawers (in the positions 20*c* or 52*b*) are located in vertical planes during removal of outermost discs 22 or 52 therefrom, such drawers occupy a relatively small amount of space so that they contribute only insignificantly to the overall dimensions of the improved apparatus. It has been found that the floor space requirements of the improved apparatus are only a fraction of floor space requirements of heretofore known apparatus for the application of inner and/or outer discs to cylindrical rolls of paper, textile material or the like.

Figure 6:
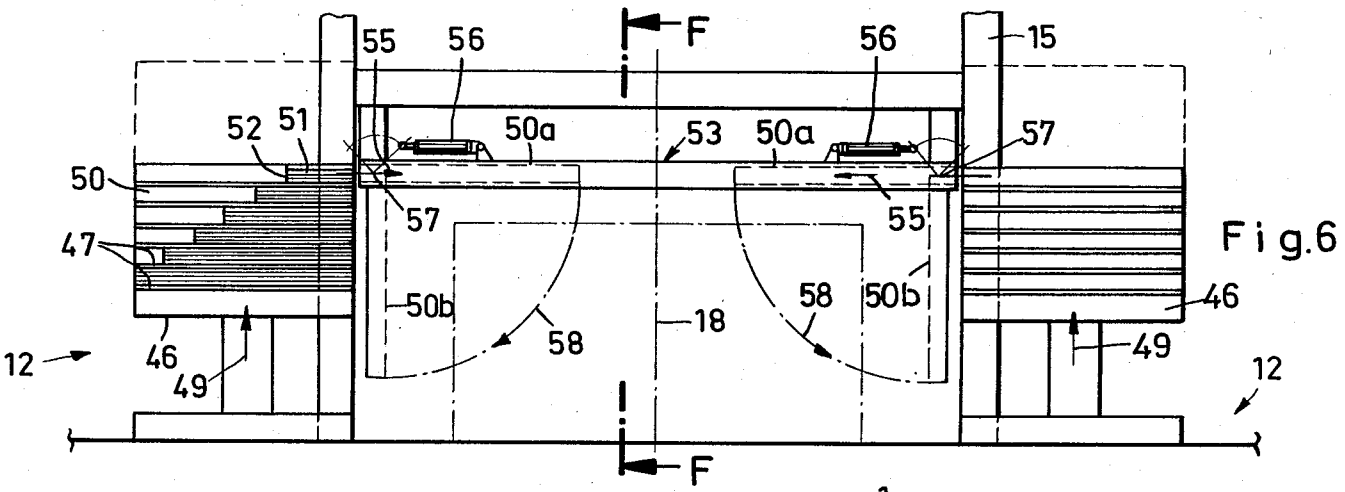
FIG. 6 is an enlarged view substantially as seen in the direction of arrows from the line D—D of FIG. 1 and shows the magazines for the outer discs as well as the mechanism which transfers outer discs into the range of combined disc-applying and pressing elements at the pressing station of the apparatus.
Figure 7:
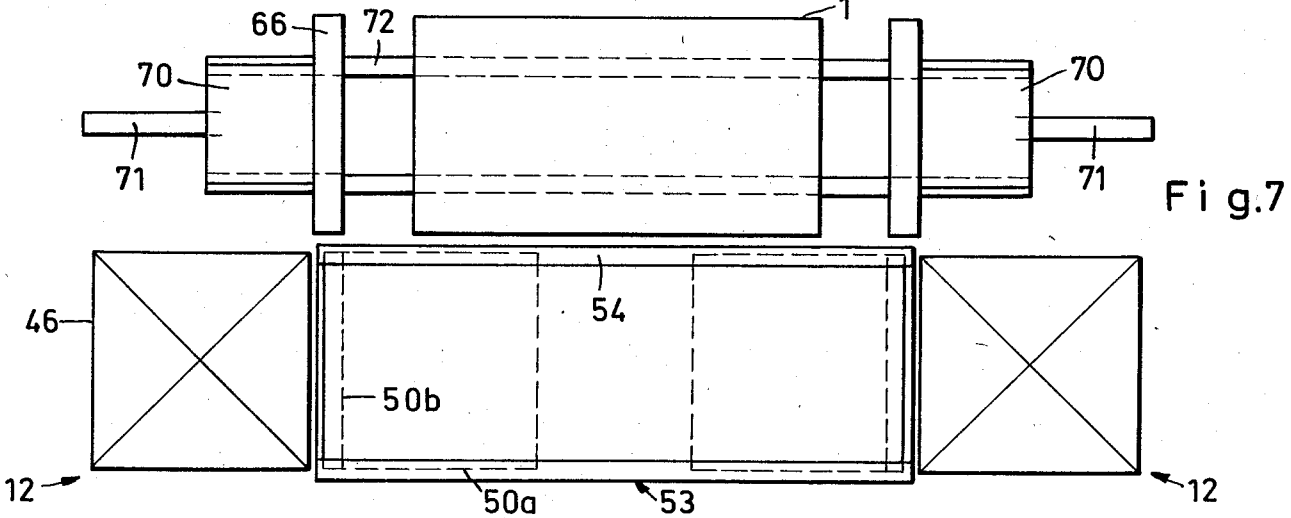
FIG. 7 is an enlarged plan view as seen in the direction of arrows from the line E—E of FIG. 1, and shows the structure of FIG. 6 as well as the pressing station.

A comparison of FIGS. 2 and 6 will indicate that the magazines 12 are nearer to the symmetry plane 18 than the magazines 3. This is due to the fact that the drawers 20 (in the positions 20*a*) do not overlie the path of movement of the rolls 1 toward the centering station 104. The pivot axes 29 are outwardly adjacent to the planes in which the respective end faces 1*e* of the rolls 1 advance toward the station 104 and inwardly adjacent to the drawers 20 in the positions 20*a*. The pivot axes 57 are also outwardly adjacent to the planes of the end faces 1*e*; however, they are outwardly adjacent to the drawers 50 in the positions 50*a*. This accounts for the fact that the magazines 12 are much nearer to the path of the rolls 1 than the magazines 3. However, even the distance between the magazines 3 and the planes of the respective end faces 1*e* need not appreciably exceed the diameter of a largest inner disc 22, i.e., the width of the apparatus is not excessive even if the magazines are not immediately adjacent to the path of the rolls 1. In each instance, i.e., irrespective of the distance between the magazines and the planes of the nearest end faces 1*e*, the drawers 20 and 50 are located in vertical or nearly vertical planes (note the drawers 20 and 50 in the positions 20*c* and 50*b*) which are outwardly adjacent to the path of movement of rolls 1 from station to station, i.e., toward the centering station 104 and toward the pressing station 113.

It is also possible to utilize magazines 3 and 12 with fixedly mounted racks (16 and 46) and to employ transporting devices 23 and 53 which are movable up and down so as to place the respective transverse conveyors 28 and 55 at the level of selected drawers 20 and 50. The arrangement which is shown in the drawing is preferred at this time because it is simpler, i.e., the transverse guides 24 and 54 need not be movable up and down because the racks 16 and 46 are mounted for movement to different levels so as to place selected drawers 20 and 50 into register with the respective conveyors 28 and 55. The transverse guides 24 and 54 are fixedly mounted in or on the housing 15, i.e., on or in the frames of the respective transporting devices 23 and 53.

An advantage of the longitudinal drives 311 is that the heads 36 need not be mounted for movement in the longitudinal direction of the path of movement of the rolls 1. Thus, the heads 36 may have to move up or down (note the lifting means 35) but they need not move in a direction to the left or to the right, as viewed in FIG. 1. In other words, the axes of the heads 36 can remain in a vertical plane which further includes the axis of a roll 1 at the station 104. Such arrangement contributes to savings in floor space for the improved apparatus.

The transferring means 59 perform the functions of the longitudinal drives 311 except that the transferring means 59 need not transport entire drawers 50 but rather only the outermost discs 52 which are removed from drawers 50 occupying the positions 50*b*. To achieve this, the suction heads 60 are mounted on the arms 61 of the transferring means 59, i.e., the heads 60 must move about the common axis of the horizontal shafts 62 in order to transport outer discs 52 in vertical planes and lengthwise of the path of movement of rolls 1 toward the stations 113.

It is clear that the two transferring means 59 can be replaced by two additional longitudinal drives 311 or vice versa. The provision of drives 311 is preferred when the designer wishes to employ relatively small suction heads (such as the suction heads 36) because these suction heads are merely required to withdraw inner discs 22 from the drawers 20 which occupy the positions 20*c*, i.e., the heads 36 need not transport the discs 22 at all because a disc which is to be transferred from a head 36 against the adjacent end face 1*e* of a roll 1 at the station 104 is simply speared by the shank 39*b* of a plug 39 which is in the process of moving into the adjacent end of a core 45. The respective plunger 42 causes the flange 39*a* of such plug 39 to strip the disc 22 off the head 36 and the plug 39 then supports the stripped off disc 22 during transport toward the adjacent end face 1*e*. This is possible because the drawers 20 are movable to the positions 20*a*, thereupon to the positions 20*b* and finally to the positions 20*c*, i.e., in vertical planes and into temporary alignment with the heads 36 at the station 104.

It is equally possible to use the longitudinal drives 311 as a means for supporting the heads 36 and for moving such heads between positions of alignment with drawers 20 (in the positions 20*b*) and with the core 45 of a roll 1 at the station 104. In such modified apparatus, the longitudinal drives 311 must be movable up and down to account for different diameters of rolls 1, or these drives must be provided with lifting means (such as 35) for moving the heads 36 up and down.

In the mechanism of FIGS. 2 to 4, the drawers 20 (in positions 20*a*) are pivotable about horizontal axes (29) adjacent to those sides of the drawers which face away from the respective magazines 3. This ensures that the heads 36 can remove discs 22 from those sides of the drawers 20 which constitute the upper sides when the drawers are stored in the respective racks 16. In the mechanism of FIGS. 6 to 9, the drawers 50 (in the positions 50*a*) are pivotable about the horizontal axes (57) which are disposed between such drawers and the respective magazines 12. This means that the open sides of the drawers 50 (namely, the sides which constitute the upper sides when the drawers 50 are stored in the respective racks 46) face the adjacent end faces 1*e* of a roll 1 between the two withdrawn drawers 50 (in the positions 50*b*). The transferring means 59 then take over to cause the heads 60 to remove the outermost discs 52 from the adjacent drawers 50 (in the positions 50*b*) and to deliver the withdrawn discs 52 into positions of alignment with the pressing plates 66 to which the discs 52 adhere due to the provision of suction ports 69. The connections between the suction ports of the heads 60 and the respective suction generating means, as well as the connections between the suction ports 69 and the respective suction generating means, can be readily regulated in such a way that the suction ports of the heads 60 are disconnected from the respective suction generating means when the arms 61 reach the positions corresponding to that shown in FIG. 8 by broken lines and that, at such time, the suction ports 69 are connected with the respective suction generating means to thus ensure automatic transfer of discs 52 from the heads 60 against the adjacent surfaces of the respective pressing plates 66.

The heads 36 can perform several functions, such as moving inner discs 22 into register with the end faces 1*e* of a roll 1 at the station 104 as well as contributing to the centering action. Thus, when the chain drive 33 moves the centering blocks 32 toward each other (as viewed in FIG. 4), the heads 36 normally move simultaneously against the respective end faces 1*e* of the roll 1 at the station 104 to thus ascertain that such roll is halved by the imaginary symmetry plane 18. If not, the roll 1 at the station 104 is engaged by one of the heads 36 ahead of the other head 36, and this entails automatic axial shifting and resulting centering of the roll. Accurate centering is desirable because the roll 1 which reaches the draping station 5 should be in an optimum position for the application of a blank 7 in such a way that the extent to which the marginal portion of the blank extends beyond the respective inner disc 22 (which is already applied by the corresponding plug 39) is the same as the extent to which the other marginal portion of the same blank 7 extends beyond the other inner disc 22 on the roll 1 at the station 5. An advantage of such centering action of the heads 36 is that the application of inner discs 22 can take place at the station (104) where the rolls 1 are centered preparatory to their advancement to the draping station 5, i.e., there is no need for the provision of a separate station at which pairs of discs 22 are attached to successive rolls 1.

The improved apparatus is susceptible of many additional modifications without departing from the spirit of the invention. For example, the various drive means and/or moving means can utilize hydraulically, pneumatically, electrically or otherwise actuatable elements. Moreover, it is possible to further automate the operation of the apparatus by employing suitable sensors which monitor the dimensions of the rolls, preferably ahead of the centering station 104 or not later than at this station. The signals which are generated by such sensors can be utilized to actuate the lifting devices 19 and 49 as well as to control the selection of that reel 8 which stores a supply 7*a* of blanks 7 having an optimum width for adequate draping of the rolls 1 arriving at the station 5. In order to prevent the discs 22 or 52 from falling out of the respective drawers (in the positions 20*b* and 20*c* or 50*b* of such drawers), it is possible to maintain the drawers in the positions 20*d* or 20*c* and 50*b* in planes which are slightly inclined with reference to a truly vertical plane. Furthermore, it is possible and often advisable to equip the drawers with suitable retaining elements which releasably engage the marginal portions of the outermost or uppermost discs 22 or 52 and hold such discs with a relatively small force which can be readily overcome by the heads 36 or 60 when such heads are ready to attract the neighboring discs 22 or 52 by suction. The retaining elements can constitute weak leaf springs or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for moving discs against or close to the end faces of substantially horizontal rolls consisting of convoluted paper or the like, comprising a magazine including a plurality of superimposed substantially horizontal receptacles for stacks of discs therein; a transporting device including conveyor means for moving a selected receptacle from and back into said magazine in a substantially horizontal plance and means for pivoting a withdrawn receptacle from the horizontal plane into a substantially vertical plane and back into said horizontal plane; means for removing a disc from a receptacle which is held in said vertical plane; and means for applying the thus removed disc to the roll.

2. The apparatus of claim 1, wherein each of said receptacles is arranged to store a supply of discs having a given diameter which deviates from the diameters of discs in each other receptacle.

3. The apparatus of claim 1, wherein said magazine has a plurality of substantially horizontal compartments, one for each of said receptacles, and said receptacles constitute drawers which are reciprocable between positions within and positions outside of the respective compartments.

4. The apparatus of claim 1, wherein said applying means comprises a suction head.

5. The apparatus of claim 1, wherein the rolls are arranged to move along an elongated path and said magazine is adjacent to one side of said path, and further comprising a second magazine at the other side of said path, said transporting device including second conveyor means for moving a selected receptacle from and into said second magazine in said horizontal plane and means for pivoting a receptacle which is withdrawn from the second magazine from said horizontal plane into a second substantially vertical plane and back into said horizontal plane, means for removing a disc from a receptacle which is held in said second vertical plane, and means for applying the thus removed disc to the roll.

6. The apparatus of claim 1, further comprising lifting means for moving said receptacles up and down so as to place a selected receptacle into said horizontal plane.

7. The apparatus of claim 6, wherein said transporting device further comprises horizontal guide means for the receptacle which is located in said horizontal plane, said conveyor means being arranged to move such receptacle along said guide means.

8. The apparatus of claim 1, wherein said applying means is spaced apart from said magazine and said removing means comprises drive means operable to move discs in said vertical plane into register with said applying means.

9. The apparatus of claim 8, wherein said drive means includes means for moving receptacles in said vertical plane in a direction at right angles to the direction of movement of such receptacles in said horizontal plane.

10. The apparatus of claim 8, wherein said drive means includes means for moving discrete discs from a receptacle in said vertical plane to said applying means.

11. The apparatus of claim 10, wherein said moving means comprises a suction head and means for moving said suction head back and forth along a predetermined path between a receptacle in said vertical plane and said applying means.

12. The apparatus of claim 11, wherein said means for moving said suction head back and forth comprises an arm which is pivotable about a predetermined axis and said path is an arcuate path.

13. The apparatus of claim 12, wherein said predetermined axis is at least substantially horizontal.

14. The apparatus of claim 1, wherein said transporting device further comprises substantially horizontal guide means for receptacles in said vertical plane and a drive for moving receptacles along said guide means back and forth substantially at right angles to the direction of travel of receptacles in said horizontal plane.

15. The apparatus of claim 1, further comprising lifting means operable to move said applying means to different levels.

16. The apparatus of claim 1, wherein said removing means comprises means for transferring discs from the receptacle in said vertical plane into register with said applying means, said transferring means comprising a suction head and further comprising lifting means arranged to move said suction head to any one of several levels.

17. The apparatus of claim 1, wherein said pivoting means includes a device for pivoting a withdrawn receptacle about a substantially horizontal axis which is disposed between said magazine and the withdrawn receptacle.

18. The apparatus of claim 1, wherein said pivoting means includes a device for pivoting a withdrawn receptacle about a substantially horizontal axis, the withdrawn receptacle being disposed between said magazine and said horizontal axis.

19. The apparatus of claim 1, further comprising means for retaining discs on the end faces of rolls and means for securing such retaining means to the respective rolls.

20. The apparatus of claim 19 for moving discs against rolls of the type having a centrally located opening with end portions in the end faces of the roll, further comprising a source of retaining means, said securing means including means for removing retaining means from said source and for moving the removed retaining means against a disc which is held by said applying means and thereupon with the disc against an end face of a roll, each retaining means having a portion receivable in one end portion of the opening in the respective roll.

21. The apparatus of claim 20 for moving discs having centrally located apertures for said portions of retaining means, said applying means comprising a suction head having a passage for withdrawing means and said means for moving the removed retaining means including means for advancing such retaining means through the suction head and thereupon into engagement with the roll.

22. The apparatus of claim 21, further comprising means for centering successive rolls in predetermined positions, said suction head forming part of said centering means.

23. The apparatus of claim 21, wherein each of said retaining means comprises a plug having a flange whose diameter exceeds the diameter of the aperture in a disc and a shank which constitutes said portion of the respective retaining means.

* * * * *